United States Patent [19]

Vegter et al.

[11] Patent Number: 4,912,954

[45] Date of Patent: Apr. 3, 1990

[54] METHOD OF ROLLING STRIP IN A ROLLING MILL AND A CONTROL SYSTEM THEREFOR

[75] Inventors: Henk Vegter; Adrianus J. Van Den Hoogen, both of Alkmaar; Gerrit J. Heesen, Heemskerk, all of Netherlands

[73] Assignee: Hoogovens Groep B.V., Ijmuiden, Netherlands

[21] Appl. No.: 174,405

[22] Filed: Mar. 28, 1988

[30] Foreign Application Priority Data

Apr. 2, 1987 [NL] Netherlands ..... 8700776

[51] Int. Cl.[4] ..... B21B 37/14

[52] U.S. Cl. ..... 72/8; 72/11; 72/60; 72/199; 72/228; 364/472

[58] Field of Search ..... 72/8, 20, 16, 10, 11, 72/364, 365, 366; 364/472

[56] References Cited

U.S. PATENT DOCUMENTS

| | | | |
|---|---|---|---|
| 4,087,859 | 5/1978 | Anbe | 72/8 X |
| 4,261,190 | 4/1981 | Fapiano | 72/6 |
| 4,385,511 | 5/1983 | Vydrin | 72/199 X |
| 4,506,532 | 3/1985 | Anbe | 72/8 |
| 4,528,834 | 7/1985 | Aoyagi et al. | 72/228 X |
| 4,658,362 | 4/1987 | Bhatt | 72/60 X |
| 4,685,063 | 8/1987 | Weihrich et al. | 72/16 X |
| 4,745,556 | 5/1988 | Turley | 72/11 X |

*Primary Examiner*—W. Donald Bray

*Attorney, Agent, or Firm*—Stevens, Davis, Miller & Mosher

[57] ABSTRACT

In the rolling of a metal strip in a rolling mill which has a rolling mill train of one or more roll stands, before the metal strip enters the rolling mill train the roll stand are each given a presetting in accordance with a predicted necessary roll force $F_i$ during rolling in roll stand i, which rolling force $F_i$ is determined by the formula $F_i = K_i * KSB_i$, in which $K_i$ is a multiplication factor and $KSB_i$ is the resistance to deformation of the metal strip during rolling through the roll stand i. To improve the average quality of the rolled product and to shorten the "learning" time when changing products, the resistance to deformation $KSB_i$ is chosen equal to an average rolling stress T for a strain E in the metal strip in roll stand i, the relationship between the rolling stress T and strain E during rolling being determined by the formula $T = C.f(E,E_c)$, in which C and $E_c$ have values dependent on the material of the strip, $E_c$ being a critical strain.

8 Claims, 4 Drawing Sheets

METHOD OF ROLLING STRIP IN A ROLLING MILL AND A CONTROL SYSTEM THEREFOR

BACKGROUND OF THE INVENTION

1. FIELD OF THE INVENTION

The invention relates to a method for rolling a metal strip in a rolling mill which has a rolling mill train of one or more roll stands. The invention also relates to a control system for operating the rolling mill in accordance with the method.

2. DESCRIPTION OF THE PRIOR ART

In one known method of rolling metal strip in a rolling mill, before the metal strip enters the rolling mill train, the roll stands are preset in accordance on a predetermined necessary roll force $F_i$ during rolling in the roll stand i, which roll force $F_i$ is determined by the formula $F_i=K_i*KSB_i$, in which $K_i$ is a multiplication factor and $KSB_i$ is the deformation resistance of the metal strip during rolling through the roll stand i. In this specification * is used as a multiplication sign.

It is customary in this method for allowance to be made in the multiplication factor $K_i$ for a geometrical factor which takes into account the shape of the strip in the roll gap, and also for a factor for the length of the contact arc in the roll gap.

The method is known in the practice of users of installations for hot rolling of steel strip. These users are confronted with a market demand for greater variety in rolled products. This means that the roll stands of the rolling mill train have to be adjusted very often in order to be able to make rolled products of the various required types. Changing the presetting leads to a learning phase during the following rolling process. During the learning phase the adjustment of the various roll stands is optimised.

During the learning phase the quality of the rolled product achieved is however less than satisfactory. Furthermore, quality requirements have become stricter in recent years, which also gives rise to more stringent requirements on the accuracy of the presetting of the roll stands. In the known method, both aspects, greater variety and higher quality requirements, lead to an increase in finished product rejection.

SUMMARY OF THE INVENTION

The object of the invention is to shorten the above-mentioned learning phase and to achieve greater reproducibility in the quality of the finished rolled products. A further object of the invention is to make it possible to use the rolling mill train more flexibly in the sense that in a rolling programme a rapid sequence of different products to be rolled may be adopted without undue negative consequences for product quality. A further object of the invention is to bring the quality level of the rolled products as a whole up to a higher level.

In the above-mentioned learning phase attempts are also made to compensate for changes in the installation characteristics and to eliminate systematic faults in the presetting of the rolls. A further object of the invention is to improve the quality of the presetting in such a way that these learning effects are no longer necessary for each new presetting, at least not to the same degree.

According to the invention in the method described above the deformation resistance $KSB_i$ is chosen equal to an average rolling stress T for a strain E in the metal strip in roll stand i, the relationship between rolling stress T and strain E during the rolling being determined by the formula $T=C.f(E,E_c)$, in which C and $E_c$, have values depending on the material, $E_c$ being a critical strain.

In this method use is made of a rolling stress-strain curve, which indicates the relationship between the rolling stress and the deformation of the metal strip. The critical strain $E_c$ represents the point at which "dynamic recrystallization" of the metal strip, that is recrystallization during deformation in the roll gap, begins to occur. This method seems to be well suited in cases where rolling programmes are applied involving a use of materials with different properties, such as deep drawing steel and HSLA steel, which are rolled into steel strip.

While maintaining the accuracy of this method of the invention, a simple way of adjusting the rolls is achieved when the formula $T=C.f(E,E_c)$ has a form which is determined by the value of the strain E, the strain E being selected from four ranges each of which has a unique form of the relationship between T and E. The advantage of this is that determining the relationship between rolling stress and strain does not require complicated calculation. The form of the formula $T=C.f(E,E_c)$ in the respective four ranges is given preferably by a. for a strain E less than a critical strain $E_c$:

$$T=C.E^{n1}$$

b. for a strain greater than or equal to the critical strain $E_c$ and smaller than 1.25 times the critical strain $E_c$:

$$T=C.E_c^{n1}$$

c. for a strain greater than or equal to 1.25 times the critical strain $E_c$ and less than twice the critical strain $E_c$:

$$T = C \cdot E_c^{nl} \cdot \left[ 1 - n2 \cdot \frac{E - n3 \cdot E_c}{n4 \cdot E_c} \right]$$

d. for a strain greater than or equal to twice the critical strain $E_c$:

$$T=C.n5.E_c$$

in which n1, n2, n3, n4 and n5 are constants.

This gives a quite simple relationship between rolling stress and strain.

Maximum accuracy in the presetting of the roll stands is achieved if C is determined by the formula $C=Co.\dot{E}^m \exp(A/Ta)$, in which E is the elongation speed, Co, m and A are constants dependent on the material and Ta is the absolute temperature of the steel strip.

Preferably in the invention also $K_i$ at least consists of a feedback factor which comprises a group of two adaptation factors, and during the rolling of a metal strip belonging to a first category of strip at the most the first adaptation factor of the group is applied and during the rolling of a metal strip belonging to a second category of strip, which excludes the first category, and second adaptation factor is applied.

It has appeared advantageous for the feedback factor to be given two groups of at least two adaptation factors, on each occasion one adaptation factor from the first group being applied simultaneously with an adaptation factor from the second group.

The first group of adaptation factors in this case is typically intended to correct roll stand adjustment faults resulting from relative hardness differences in the metal strip and systematic errors in the roll force prediction as a consequence of model errors, while the second group of adaptation factors is typically intended to correct adjustment faults on the roll stands as a consequence of installation errors and as a consequence of incomplete "static recystallization" of the steel strip, that is recrystallization between the roll stands.

This version of the method has the advantage that due to the different adaptation factors in the prediction of the roll forces, little learning time is needed when the category of the strip material to be rolled is changed. In particular, a successful subdivision seems to exist when the first group consists of two level factors and the second group has two relative factors for which a value is determined for each roll stand in relation to the level factor. This group subdivision can be extended still further as required without deviating from the essential concept of the invention.

In another aspect, the invention provides a control system for operating a rolling mill in accordance with the method of the invention described above. The control system comprises data input means, a processing unit, a memory and data output means, wherein the data input means is connected to transducers on the roll stands of the rolling mill train and to a strip thickness measuring device in the rolling mill, and the date output means is connected to adjusting means of the roll stands. The memory is provided with a program instruction adapted to cause the processing unit, by using data from the data input means, to generate further data and to supply it to the data output means so as to cause adjustment of the roll stands in accordance with the method of the invention. Such a control system can be set up without difficulty using conventional apparatus and techniques.

BRIEF INTRODUCTION OF THE DRAWINGS

In the non-limitative preferred embodiment which follows the invention will be illustrated in greater detail with reference to the accompanying drawings, in which:

FIG. 1 shows the relation between rolling stress and strain on the basis of the subdivision into ranges according to the invention.

FIGS. 2*a*–2*e* show some results of the method according to the invention.

DESCRIPTION OF THE PREFERRED EMBODIMENT

For the calculation of the roll force per width unit of a steel strip to be rolled use is made of the formula $$F_i = C_{adap} * KSB_i * Qp * LC$$

in which $F_i$=the roll force for roll stand i $C_{adap}$=a feedback factor $KSB_i$=the deformation resistance in the roll stand i Qp=a geometrical factor Lc=a constant arc length.

The product of $C_{adap}$, Qp and Lc is equal to the above-mentioned factor $K_i$ for the roll stand i. The deformation resistance $KSB_i$ during rolling is a function of the strain E, the speed of elongation E, the absolute temperature Ta of the steel strip and a critical strain $E_c$. The form of the graph which shows this relationship between the rolling stress T and the strain E is given in FIG. 1.

Figure 1:
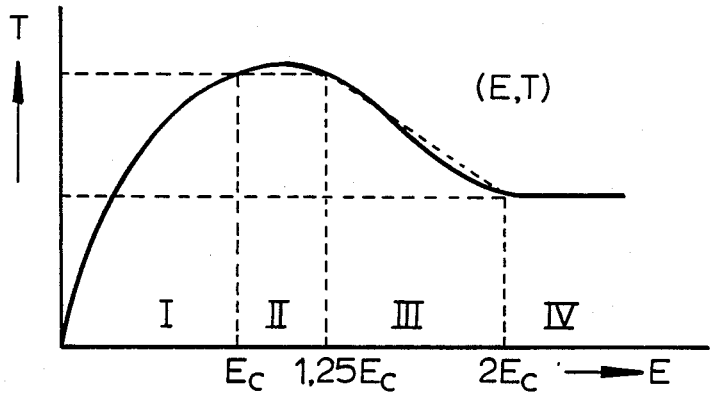

In FIG. 1 four ranges I–IV are distinguished. For a strain E smaller than the critical strain $E_c$, i.e. the area where no dynamic recrystallisation of the steel strip takes place, the relationship is given by the formula $T = C.E^{n1}$; where C is a value dependent on the material.

For the ranges II, III and IV we have:

$$II = E_c \leqq E < 1.25 * Ec \; T = C \cdot E_c^{nl}$$

$$III = 1.25 * E_c \leqq E < 2E_c \; T = C \cdot E_c^{nl} \cdot \left[ 1 - n2 \cdot \frac{E - n3 \cdot E_c}{n4 \cdot E_c} \right]$$

$$IV = 2E_c \leqq E < \infty \; T = C \cdot n5 \cdot E_c$$

where n1, n2, n3, n4 and n5 are constants.

The geometrical factor Qp for a roll stand i is dependent on the amount of reduction, the radius of the elastically deformed rolls, the thickness of the metal strip on emerging from the roll stand i, the entrance and exit tensile stresses in the strip, the deformation resistance $KSB_i$ already mentioned and finally the friction coefficient of the metal strip in the roll gap.

For stand i this factor $C_{adap}$ is made up of four adaptation factors:

$$C_{adap} = C_{mod} * C_{hard} * C_{error} * C_{recry}.$$

The adaptation factors $C_{mod}$, $C_{hard}$, $C_{error}$, and $C_{recry}$ are adjusted depending on the grade of steel which is to be rolled and/or the dimensions of the strip and/or of the roll stand i in such a way that firstly corrections as a consequence of systematic deviations and changes in the roll stands and secondly differences in the quality of the strip material are compensated for.

During the rolling of each strip two adaptation factors are applied, a mean value for all roll stands ($C_{mod}$ or $C_{hard}$), and a factor depending on the stand ($C_{error}$ or $C_{recry}$). The last two adaptation factors are chosen relative to the first two mentioned.

In the following the expression "deep drawing steel" is understood to mean a grade of steel in which complete recrystallization occurs between the roll stands.

The choice of which adaptation factor should be applied depends on the quality of the steel. If the strip belongs to a reference group of deep drawing steel, $C_{mod}$ and $C_{error}$ will be applied. In so doing the factor $C_{mod}$ automatically stands for the mean model deviation because the control model according to which the roll stands are preset is calibrated on this reference group. The factor dependent on the stand $C_{error}$ comprises the systematic deviations and changes in the rolling installation.

$C_{hard}$ is applied if a strip is rolled from a group other than the reference group. When rolling a deep drawing steel not belonging to the reference group, only the level of the roll forces is different and the relative hardness of the strip recurs in this factor. The deviation per stand with reference to this hardness is equal to the deviation in the case of rolling a strip from the reference group. Consequently the stand-dependent factor which has to be applied in this case is the same, namely $C_{error}$.

If a non-completely recrystallizing steel is rolled, in other words a non-deep drawing steel, then the factors $C_{hard}$ and the stand-dependent factor $C_{recry}$ must be applied. $C_{hard}$ has the significance of a mean hardness of the strip. Increase in the hardness over the roll stands by partial recrystallization recurs in an increase for each roll stand in the factor $C_{recry}$.

The above-mentioned factors $C_{mod}$, $C_{hard}$, $C_{error}$ and $C_{recry}$ which together form $C_{adap}$, work together with the factors Qp and Lc and then give the above-mentioned strengthening factor $K_i$.

The deformation resistance $KSB_i$ is determined from the four-part formula which gives the relationship between the rolling stress T and the strain E. The factor C, which occurs here also, is determined by the formula $C=C_o.\dot{E}^m \exp(A/Ta)$ in which E is the elongation speed, $C_o$, m and a are constants dependent on the material and Ta is the absolute temperature.

In practice the following results are obtained with a rolling programme involving various deep drawing steels. The differences in the rolling programme are hardness differences and differences in rolling reduction. With this rolling programme (see FIG. 2) the reference group of the deep drawing steel is determined in that the carbon content lies within the range of 0.025–0.075 wt.% and the manganese content in the range 0.175–0.275 wt.%.

Figure 2A:
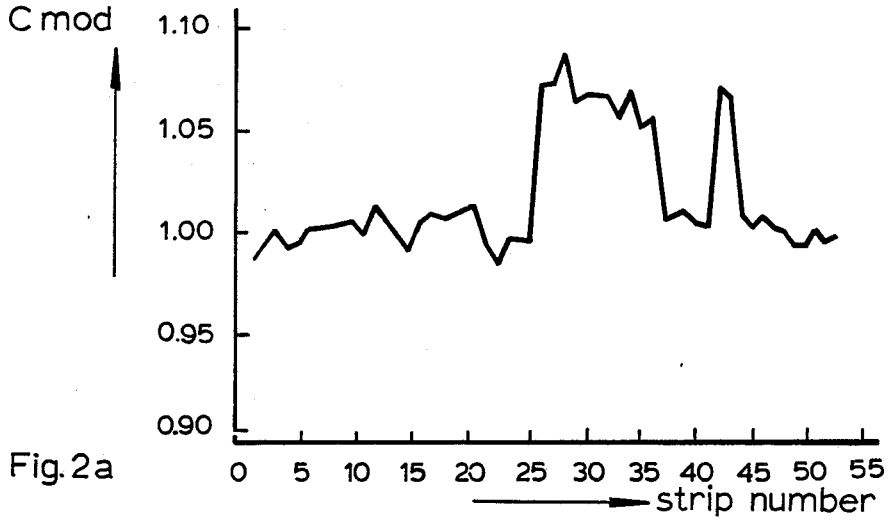

According to the example, the factor $C_{mod}$ shows the deviation from the rolling model which according to FIG. 2*a* lies within a range of 1%. The factor $C_{hard}$ describes, as already stated, the relative hardness of the other grades of steel. In the case referred to, the relative hardness of the strips which do not fall within the reference group is 1.07. In FIG. 2*a* these are strip numbers 27 to 38, 43 and 44.

Figure 2B:
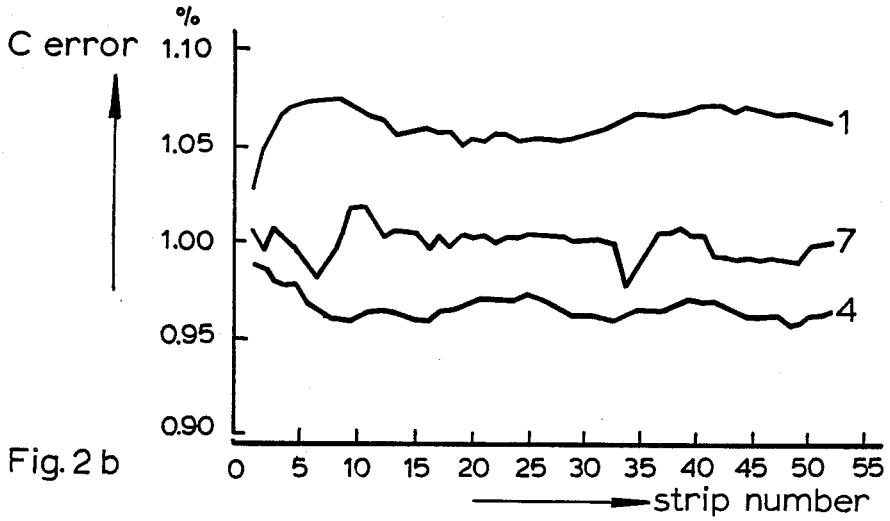
Figure 2C:
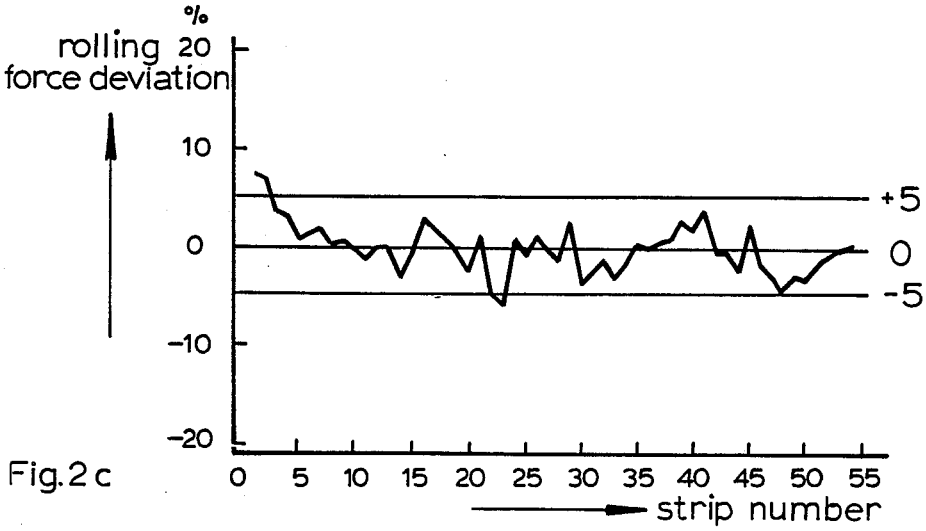
Figure 2D:
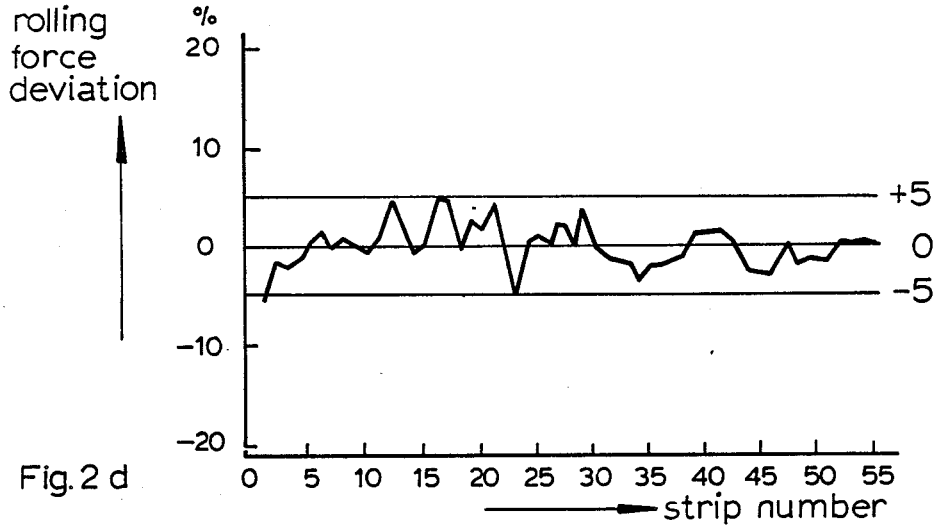
Figure 2E:
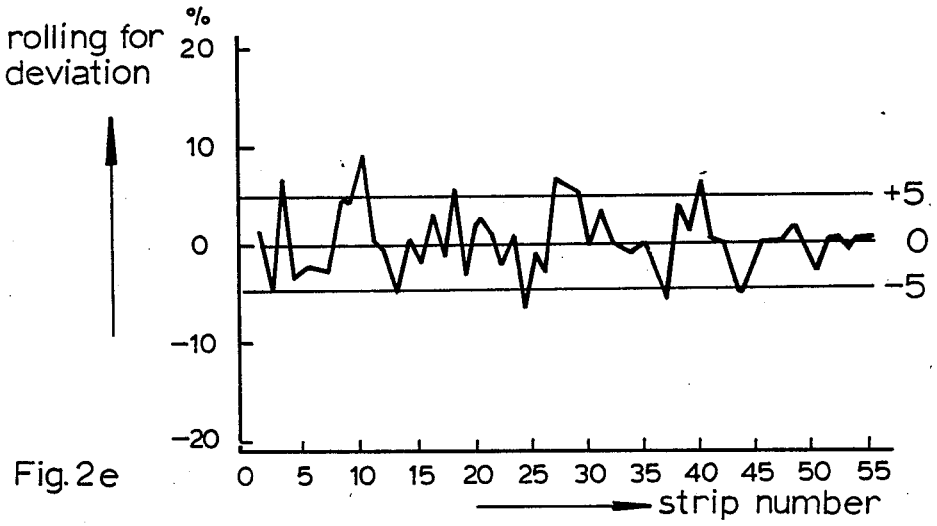

The factor $C_{error}$ which is a measure of the systematic deviation in the installation, is shown for roll stands 1, 4 and 7 in FIG. 2*b*. The changes in this factor take place quite gradually. The deviations between preset and measured roll force cause at the beginning of the rolling programme, a rather more rapid application of the factor $C_{error}$. The remaining correction with $C_{error}$ for stands 1 and 4 comes to 2 to 3% and for stand 7 to 4%. This greater deviation in the case of stand 7 results from a greater uncertainty in the determination of the thickness of the steel strip between the 6th and 7th roll stands. The roll stands adjusted in accordance with the described method give a deviation in the measured rolling forces which remains within a range of ±5%. This is shown for roll stands 1, 4 and 7 in sequence in FIGS. 2*c*, 2*d* and 2*e*. In these figures the y-axis gives in percent the deviation in the roll force and the x-axis the strip number.

In Table 1 below are assembled some results of the head thickness which are obtained using the method according to the invention.

TABLE 1

| Thickness group | Tolerance | Number of strips | Number outside tolerance | Average Group | % Good |
|---|---|---|---|---|---|
| a. 1.6–3.0 mm | 0.08 mm | 1589 | 83 | 2.8 | 94.8 |
| b. 3.0–4.0 mm | 0.10 mm | 1125 | 35 | 2.5 | 96.9 |
| c. 4.0–6.0 mm | 0.12 mm | 1462 | 39 | 2.3 | 97.3 |
| d. 6.0–8.0 mm | 0.15 mm | 248 | 6 | 1.8 | 97.6 |
| e. 8.0–10.0 mm | 0.18 mm | 79 | 0 | 2.0 | 100.0 |
| f. 10.0–16.0 mm | 0.20 mm | 224 | 7 | 1.9 | 96.9 |

Table 1 may be explained as follows: in line f it is shown that 224 steel strips have been rolled of which the required thickness lies in the range 10.0–16.0 mm. Of these 224 steel strips seven seem to be outside the permitted thickness tolerance of ±0.10 mm, which means that in this thickness group 96.6% of the rolled steel strips were produced with a thickness deviation of less than ±1%. The average group size, i.e. the number of steel strips which fall within the same thickness group and which were rolled directly after each other, came to only 1.9.

Figure 3:
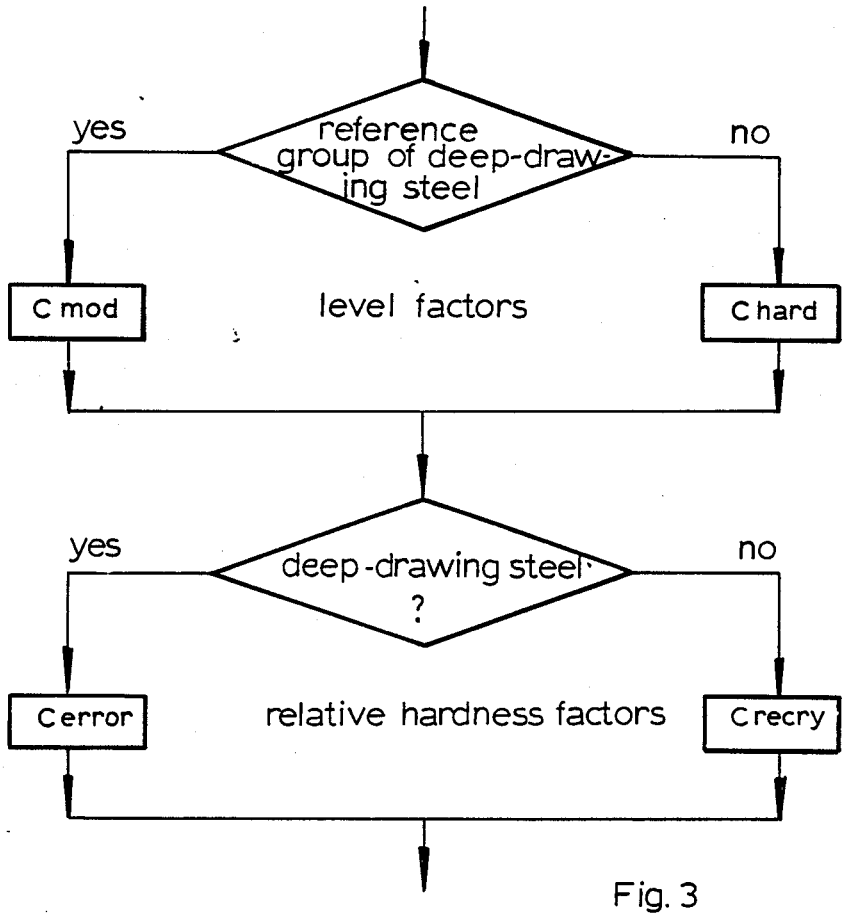
FIG. 3 shows the choice of adaptation factors according to the invention.

The choice of the adaptation factor to be applied is made clear in FIG. 3.

First of all a test is carried out to see whether the strip is be rolled belongs to the reference group. If so, then $C_{mod}$ is applied. In view of the fact that the model is calibrated to the use of deep drawing steel which falls within the reference group, deviations of $C_{mod}$ in relation to "one" must be explained by model faults. If a strip to be rolled does not belong to steel from the reference group, $C_{hard}$ is applied. The variation in $C_{hard}$ is caused by hardness differences in the rolled metal strip in relation to the steel from the reference group.

A second point of choice concerns the question of whether a deep drawing steel is being rolled. Differences which are observed between predicted and measured roll forces are represented in the case of deep drawing steel by a factor $C_{error}$, which has a value for each roll stand. This concerns therefore chiefly differences resulting from changes in the process conditions. $C_{recry}$ is applied when rolling non-deep drawing steel, for example an HSLA steel, is being rolled.

The changed process conditions are already represented by $C_{error}$. $C_{recry}$ compensates for the observed increase in relative hardness over the roll stands. This arises because the deformation in a roll stand, in particular in the case of HSLA steel, gives an incomplete recrystallized strip structure on entry into the next roll stand. Consequently the hardness in the case of HSLA steel increases in each roll stand.

Figure 4:
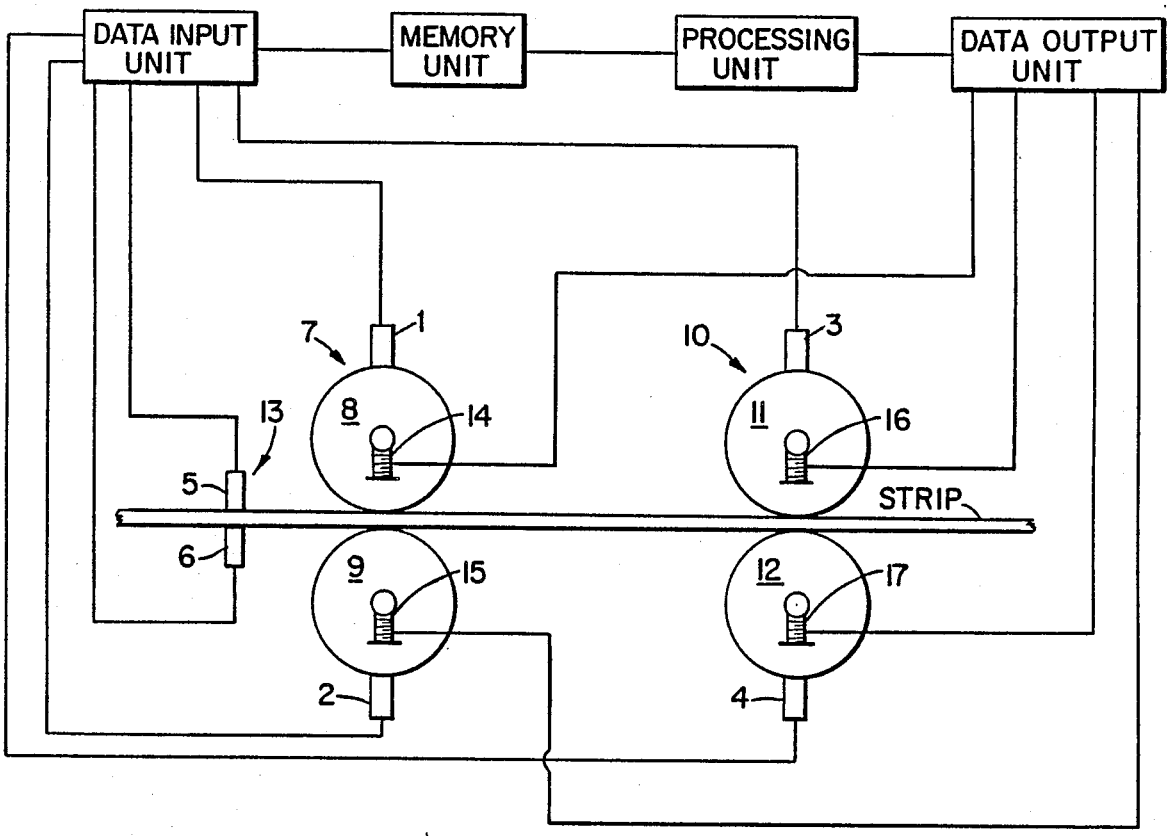
FIG. 4 shows a control system for the rolling stands.

The method described in this embodiment is preferably implemented by a suitable control system as described in FIG. 4. With reference to FIG. 4 the control system comprises data input unit, a memory unit, a processing unit and a data output unit, wherein the data input unit is connected to transducers 1, 2, 3 and 4 on the roll stands 7 and 10 composed of rolls 8 and 9 and 11 and 12 respectively of the rolling mill train and to a strip thickness measuring device 13 composed of feelers 5 and 6 in the rolling mill. The data output unit is connected to adjusting means 14, 15, 16, 17 of the roll stands. The memory unit is provided with a program instruction adapted to cause the processing unit, by using data from the data input means, to generate further data and to supply it to the data output means so as to cause adjustment of the roll stands. Technically this means a reliable and flexible solution. Economically it is relatively cheap and gives the possibility of cheap maintenance.

What is claimed is:

1. Method of rolling a metal strip in a rolling mill which has a rolling mill train of at least one roll stand, the method including the step of, before the metal strip enters the rolling mill train, giving each roll stand a presetting in accordance with a predicted necessary roll force $F_i$ during rolling in roll stand i, which rolling force $F_i$ is determined by the formula $F_i = K_i * KSB_i$, in which $K_i$ is a multiplication factor and $KSB_i$ is the resistance to deformation of the metal strip during rolling through the roll stand i, said resistance to deformation $KSB_i$ being chosen equal to an average rolling stress T for a strain E in the metal strip in roll stand i, the relationship between the rolling stress T and strain E during rolling being determined by the formula $T = C.f(E,E_c)$, in which C and $E_c$ have values dependent on the material of the strip, $E_c$ being a critical strain.

2. Method according to claim 1, wherein the formula $T = C.f(E,E_c)$ has of a form which is determined by the value of the strain E, the strain E being selected from four ranges, each range having a different form of the relationship between T and E.

3. Method according to claim 2, wherein the form of the formula $T = C.f(E,E_c)$ in the respective four ranges is given by a. for a strain E less than a critical strain $E_c$:

$$T = C.E^{n1}$$

b. for a strain greater than or equal to the critical strain $E_c$ and less than 1.25 times the critical strain $E_c$:

$$T = C.E_c^{n1}$$

c. for a strain greater than or equal to 1.25 times the critical strain $E_c$ and less than twice the critical strain $E_c$:

$$T = C \cdot E_c^{n1} \cdot \left[ 1 - n2 \cdot \frac{E - n3 \cdot E_c}{n4 \cdot E_c} \right]$$

d. for a strain greater than or equal to twice the critical strain $E_c$:

$$T = C.n5.E_c$$

where n1, n2, n3, n4 and n5 are constants.

4. Method according to claim 1, wherein C is determined by the formula $C = Co.\dot{E}^m \exp(A/Ta)$ in which E is the elongation speed, Co, m and A are constants dependent upon the material and Ta is the absolute temperature of the metal strip.

5. Method according to claim 1 wherein $K_i$ consists at least of a feedback factor which comprises a group of two adaptation factors, and during the rolling of a metal strip belonging to a first category of strip at most the first adaptation factor of the group is applied and during the rolling of a metal strip belonging to a second category of strip, which excludes the first category, the second adaptation factor is applied.

6. Method according to claim 5, wherein said feedback factor is given two groups of at least two adaptation factors, and on each occasion one adaptation factor from a first group is applied at the same time as one adaptation factor from the second group.

7. Method according claim 6, wherein said first group consists of two level factors and said second group has two relative hardness factors a value of which is determined for each roll stand.

8. Control system for operating a rolling mill train which has at least one roll stand, transducers on each roll stand, adjusting means on each roll stand, and strip thickness measuring means, the control system comprising data input means, a data processing unit, a memory and data output means, wherein the data input means is connected to said transducers on the roll stands and to said a strip thickness measuring means, and the data output means is connected to said adjusting means of the roll stands, the memory being provided with a program adapted to cause the processing unit, by using data from the data input means to generate further data and to supply it to the data output means so as to cause adjustment of the roll stands.

* * * * *